US008324139B2

(12) United States Patent
Gieselman

(10) Patent No.: US 8,324,139 B2
(45) Date of Patent: Dec. 4, 2012

(54) MANNICH POST-TREATMENT OF PIBSA DISPERSANTS FOR IMPROVED DISPERSION OF EGR SOOT

(75) Inventor: Matthew D. Gieselman, Willoughby Hills, OH (US)

(73) Assignee: The Lubrizol Corporation, Wicklife, OH (US)

( * ) Notice: Subject to any disclaimer, the term of this patent is extended or adjusted under 35 U.S.C. 154(b) by 483 days.

(21) Appl. No.: 12/373,918

(22) PCT Filed: Aug. 1, 2007

(86) PCT No.: PCT/US2007/074959

§ 371 (c)(1),
(2), (4) Date: Jan. 15, 2009

(87) PCT Pub. No.: WO2008/016967

PCT Pub. Date: Feb. 7, 2008

(65) Prior Publication Data

US 2010/0016192 A1 Jan. 21, 2010

Related U.S. Application Data

(60) Provisional application No. 60/821,281, filed on Aug. 3, 2006.

(51) Int. Cl.

| | |
|---|---|
| ***C10M 169/04*** | (2006.01) |
| ***C10M 159/12*** | (2006.01) |
| ***C10M 159/16*** | (2006.01) |
| ***C08G 4/00*** | (2006.01) |

(52) U.S. Cl. ..... 508/287; 525/473

(58) Field of Classification Search ..... 508/287; 525/473

See application file for complete search history.

(56) References Cited

U.S. PATENT DOCUMENTS

| | | | | |
|---|---|---|---|---|
| 4,248,725 | A | | 2/1981 | Crawford et al. |
| 4,354,950 | A | * | 10/1982 | Hammond et al. ..... 508/292 |
| 5,102,570 | A | | 4/1992 | Migdal et al. |
| 5,256,325 | A | | 10/1993 | Emert et al. |
| 6,107,258 | A | | 8/2000 | Esche, Jr. et al. |

FOREIGN PATENT DOCUMENTS

EP 0909805 A1 4/1999

OTHER PUBLICATIONS

Search Report from corresponding PCT Publication 2008/016967 A3 dated Apr. 10, 2008.

* cited by examiner

*Primary Examiner* — Cephia D Toomer
*Assistant Examiner* — Vishal Vasisth
(74) *Attorney, Agent, or Firm* — Christopher D. Hilker; David M. Shold

(57) ABSTRACT

A composition of the reaction product of (a) an polyisobutylene substituted succinimide dispersant; (b) an amine component comprising at least one aromatic amine containing at least one N—H group capable of condensing with said carboxylic acid functionality; and (c) an aldehyde; which may optionally be reacted with (d) a maleinated copolymer, is a useful dispersant viscosity modifier.

20 Claims, No Drawings

MANNICH POST-TREATMENT OF PIBSA DISPERSANTS FOR IMPROVED DISPERSION OF EGR SOOT

This application is a 371 of PCT/US07/74959, filed Aug. 1, 2007 which claims benefit of 60/821,281, filed Aug. 3, 2006.

BACKGROUND OF THE INVENTION

The present invention relates to dispersants for use in fuels and in engine oil lubricants, especially for reducing soot-induced viscosity increase in heavy duty diesel engines.

Heavy duty diesel vehicles may use exhaust gas recirculation (EGR) engines in efforts to reduce environmental emissions. Among the consequences of recirculating the exhaust gas through the engine are different soot structures and increased viscosity of the oil at lower soot levels, compared with engines without EGR. It is desirable that oil exhibit minimal viscosity increase, e.g., less than 12 $mm^2$/sec (cSt) at a soot loading of 6%. A material that attenuates viscosity increase typically disperses soot up to high soot loading.

Dispersants have been used to improve the soot handling capabilities of lubricants and dispersants have also been reacted with various agents in order to improve their performance. U.S. Pat. No. 5,102,570, Migdal et al., Apr. 7, 1992, discloses a lubricating composition which has a major amount of oil and a minor amount of a dispersant prepared by coupling an alkenyl succinimide with an aldehyde and a hydroxyaromatic amine that can then be acylated.

U.S. Pat. No. 6,107,258, Esche et al., Aug. 22, 2000, discloses functionalized olefin copolymers that provide dispersancy properties, comprising acylated olefin copolymers containing a reactive carboxylic functionality reacted with a coupling compound which contains more than one amine, thiol and/or hydroxy functionality which is also reacted with a performance enhancing compound which contains only one functional group capable of reacting with the carboxylic functionality of the acylated olefin copolymer. See also the European Patent Application 909,805, Esche et al., filed Oct. 7, 1998, covering the same invention.

The present invention provides a polybutylene-based dispersant that is post-treated with an amine and an aldehyde, and optionally with a maleinated olefin copolymer. The present invention is distinguished from earlier dispersants by means of, among other things, the use of amines and aldehydes and optionally maleinated olefin copolymers in the post-treatment. The present materials typically exhibit superior performance in soot handling tests. Moreover, the synthesis of the present materials is based upon polybutylene dispersants which are typically significantly simpler and less costly than the synthesis of dispersants based on ethylene/propylene copolymers. In the preparation of polybutylene-based dispersants, the polymer preparation typically only requires a single catalyst, and extremely flammable hydrogen gas is not required as a chain terminator. The polymers in question have the advantage of providing olefin unsaturation and thus being suitable for further functionalization with or without a catalyst or solvent.

The present invention, therefore, solves the problem of providing a low cost dispersant having improved performance in soot handling tests, providing a good viscosity index and good soot dispersion and toleration properties, particularly in diesel engines, and especially in heavy duty diesel engines employing exhaust gas recirculation.

SUMMARY OF THE INVENTION

The present invention provides a composition comprising the reaction product of:

(a) a polybutylene-substituted succinimide dispersant; and (b) an aromatic amine containing at least one N—H group; and (c) an aldehyde;

which may optionally be further reacted, in any order or simultaneously, with:

(d) a maleinated copolymer.

The present invention further provides a method for lubricating a mechanical device, including an internal combustion engine, comprising supplying thereto the above composition.

The present invention further provides a lubricant composition comprising a major amount of an oil of lubricating viscosity and a minor amount of the composition described above. Such lubricant composition may further comprise at least one additive selected from the group consisting of detergents, viscosity modifiers, antioxidants, and anti-wear agents.

The present invention also provides a concentrate suitable for dilution with oil of lubricating viscosity to prepare a lubricant for a mechanical device, including an internal combustion engine, comprising the composition described above.

The present invention further provides a process for lubricating a mechanical device, including an internal combustion engine, comprising supplying thereto the composition described above.

Also provided is a process for improving the soot-handling performance of a lubricating oil composition incorporating into said composition a minor amount of the composition described above.

The present invention also provides a process for post-treating a polyisobutylene substituted succinimide dispersant, comprising reacting:

(a) a polybutylene-substituted succinimide dispersant; and (b) an aromatic amine containing at least one N—H group;

(c) an aldehyde;

which may optionally be further reacted, in any order or simultaneously, with:

(d) a maleinated copolymer.

The present invention also provides a process for lubricating an internal combustion engine, comprising supplying thereto to the lubricant composition described above.

DETAILED DESCRIPTION OF THE INVENTION

Various preferred features and embodiments will be described below by way of non-limiting illustration.

Components (a) the dispersant, (b) the aromatic amine and (c) the aldehyde, and optionally (d) the maleinated copolymer, may be reacted by adding an amine to a dispersant prepared in a typical amount of diluent oil and then adding an aldehyde over time while warming the mixture to temperatures typically between 85° C. and 120° C. The material may then be mixed at temperatures typically between 110° C. and 155° C. and may be held for 1.5 hours to 8 hours.

Optionally, a maleinated copolymer diluted with oil may be added to the material over time. The material may then be mixed at temperatures typically between 110° C. and 160° C. and may be held for 0.5 hours to 8 hours. Permissible variations in such process parameters will be apparent to the person skilled in the art. The resulting material gives good relative performance for soot handling and oxidative stability compared to the initial dispersant used.

Component (a), the dispersant, considered on an oil free basis, generally may be used in the reaction such that it makes up 30% to 60% by weight, or 38% to 49.5% by weight, or 46.5% to 49.5% by weight of all materials charged. Component (b), the aromatic amine, generally may be reacted with the dispersant such that it makes up 0.1% to 10% by weight, or 0.8% to 5% by weight, or 1% to 5% by weight of all materials charged. Component (c), the aldehyde, may be added at 0.001% to 5% by weight, or 0.08% to 1% by weight, or 0.1% to 1% by weight. Component (d), the maleinated copolymer, as an optional reactant, generally may be reacted with the dispersant, either before after or at the same time as the aldehyde and amine, such that it makes up 0% to 15% by weight, or 1% to 11% by weight, or 7% to 11% by weight of all materials charged. The balance of the charges are made up of diluent oil or other diluents or solvents, which may be present at 30% to 60% by weight, 38% to 49.5% by weight, or 46.5% to 49.5% by weight of all materials charged. This diluent oil may be added with the dispersant, separately from the dispersant, or both. The reaction may be run with additional diluents present that do not participate in the reaction such as diluent oil and solvents.

Alternatively, the amounts of components that may be used can be expressed excluding diluent oil and other solvents or diluents and listing ranges based solely on charges of materials that participate in the reaction. In this situation, Component (a), the dispersant, considered on an oil free basis, generally may be used in the reaction such that it makes up 50% to 98% by weight, or 61% to 98% by weight, or 87% to 98% by weight of all reactants charged. Component (b), the aromatic amine, generally may be reacted with the dispersant such that it makes up 0.1% to 15% by weight, or 1.3% to 10% by weight, or 1.9% to 7% by weight of all reactants charged. Component (c), the aldehyde, may be added at 0.001% to 10% by weight, or 0.1% to 5% by weight, or 0.2% to 2% by weight. Component (d), the maleinated copolymer, as an optional reactant, generally may be reacted with the dispersant, either before after or at the same time as the aldehyde and amine, such that it makes up 0% to 30% by weight, or 2% to 25% by weight, or 14% to 22% by weight of all reactants charged. The reaction may be run with additional diluents present that do not participate in the reaction such as diluent oil and solvents.

(a) The dispersant. The first component of the present invention is the polybutylene succinimide dispersant. Succinimide dispersants are well known in the art and are N-substituted long chain alkenyl succinimides, having a variety of chemical structures including typically

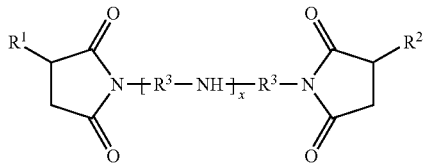

where each $R^1$ and $R^2$ is independently a hydrocarbyl or alkyl group (which may be substituted by more than one succinimide group), frequently a polybutene group with a molecular weight of 500-5000, and $R^3$ are alkylene groups, commonly ethylene ($C_2H_4$) groups. Such molecules are commonly derived from reaction of an alkenyl acylating agent with an amine, including monoamines, polyamines (illustrated in the formula above), and hydroxyamines, and a wide variety of linkages between the two moieties is possible besides the simple imide structure shown above, including a variety of amides and ammonium salts.

The $R^1$ and $R^2$ groups in the above structure generally contain an average of at least 8, or 30, or 35 up to 350, or to 200, or to 100 carbon atoms. In one embodiment, the hydrocarbyl group is derived from a polybutene characterized by an $\overline{M_n}$ (number average molecular weight) of at least 500. Generally, the polybutene is characterized by an $\overline{M_n}$ of 500, or 700, or 800, or even 900 up to 5000, or to 2500, or to 2000, or to 1500 or to 1200. Polybutenes, which may form the hydrocarbyl substituent, may be prepared by polymerizing butene monomers by well known polymerization methods, as described above, and are also commercially available. A useful butene source is a $C_4$ refinery stream having a 35 to 75 weight percent butene content and a 30 to 60 weight percent isobutene content. Useful polyolefins include polybutylenes having a number average molecular weight of 140 to 5000, in another instance of 400 to 2500, and in a further instance of 140 or 500 to 1500. The polybutylene can have a vinylidene double bond content of 5 to 69%, in a second instance of 50 to 69%, and in a third instance of 50 to 95%.

The types of amines which may be used to prepare the dispersant include monoamines, polyamines, alkanolamines, thiol-containing amines, and mixtures thereof. In order to be suitably reactive, the amine should contain at least one primary or secondary amine nitrogen atom, unless another reactive moiety, such as an OH group, is also present. The condensation product can be amide or imide, in the case of a monoamine or polyamine or an amide and/or heterocyclic and/or ester reaction product in the case of an alkanolamine.

The amine can be a monoamine having one amine group and includes primary and secondary monoamines such as methylamine and dimethylamine. The monoamine can typically have 1 to 30 carbon atoms or 2 to 18 or 3 to 12 carbon atoms. Alternatively, the amine can be a polyamine having two or more amine groups where a first amine group is a primary amine group and a second amine group is a primary or secondary amine group. The reaction product of the monocarboxylic acylating agent and the polyamine can contain, in greater or lesser amounts depending on reaction conditions, a heterocyclic reaction product such as 2-imidazoline reaction products. The polyamine can typically have 2 to 30 carbon atoms. The polyamine can include alkylenediamines, N-alkyl alkylenediamines, and polyalkylenepolyamines. Useful polyamines include ethylenediamine, 1,2-diaminopropane, N-methyl-ethylenediamine, N-tallow($C_{16}$-$C_{18}$)-1,3-propylenediamine, N-oleyl-1,3-propylenediamine, polyethylenepolyamines such as diethylenetriamine and tri-ethylenetetramine and tetraethylenepentamine and polyethylenepolyamine bottoms.

The amine can also be an alkanolamine having at least one amine group and at least one hydroxyl group, where the amine group is a primary, secondary or tertiary amine group. The alkanolamine can have 2 to 30 carbon atoms. The alkanolamine can include mono-, di- and trialkoxylates of ammonia such as mono- and di- and triethanolamine, hydroxy-containing monoamines such as a diethoxylated $C_{16}$ to $C_{18}$ tallowamine, and hydroxy-containing polyamines such as 2-(2-aminoethylamino)ethanol.

The amine used in preparing the succinimide dispersant may also be an aromatic amine, as described below for the amine component (b).

Succinimide dispersants and their methods of preparation are more fully described in U.S. Pat. Nos. 4,234,435 and 3,172,892.

(b) The Aromatic Amine. The amines suitable for use in this invention include aromatic amines. Aromatic amines include those which can be represented by the general structure Ar—NH—R where Ar is an aromatic group, as described below and R is hydrogen or a hydrocarbyl group, such as, among other groups disclosed herein, —H and —$C_{1-18}$ alkyl groups. Other groups may of course be present on the aromatic ring as well, such as nitro groups, —NH—Ar, —N═N—Ar, —NH—CO—Ar, —OOC—Ar, —OOC—$C_{1-18}$ alkyl, —COOC—$C_{1-18}$ alkyl, —OH, —O—$(CH_2CH_2—O)_nC_{1-18}$ alkyl groups, and —O—$(CH_2CH_2—O)_nAr$ (where n is 0 to 10).

Aromatic amines also include those which can be represented by the general structure $NH_2$—Ar. In such aromatic amines Ar is an aromatic group, including nitrogen-containing aromatic groups and Ar groups including any of the following structures:

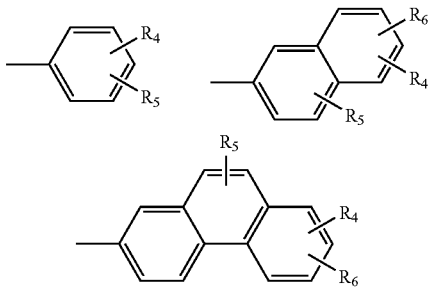

as well as multiple non-condensed aromatic rings. In these and related structures, $R_4$, $R_5$, and $R_6$ can be independently, among other groups disclosed herein, —H, —$C_{1-18}$ alkyl groups, nitro groups, —NH—Ar, —N═N—Ar, —NH—CO—Ar, —OOC—Ar, —OOC—$C_{1-18}$ alkyl, —COO—$C_{1-18}$ alkyl, —OH, —O—$(CH_2CH_2—O)_nC_{1-18}$ alkyl groups, and —O—$(CH_2CH_2O)_nAr$ (where n is 0 to 10).

Aromatic amines include but are not limited to those amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, especially those derived from naphthalene. Examples of aromatic amines include aniline, N-alkylanilines such as N-methyl aniline, and N-butylaniline, di-(para-methylphenyl)amine, naphthylamine, 4-aminodiphenylamine, N,N-dimethylphenylenediamine, 4-(4-nitrophenylazo)aniline (disperse orange 3), sulfamethazine, 4-phenoxyaniline, 3-nitroaniline, 4-aminoacetanilide (N-(4-aminophenyl)acetamide)), 4-amino-2-hydroxy-benzoic acid phenyl ester (phenyl amino salicylate), N-(4-amino-phenyl)-benzamide, various benzylamines such as 2,5-dimethoxybenzylamine, 4-phenylazoaniline, and substituted versions of these. Other examples include para-ethoxyaniline, para-dodecylaniline, cyclohexyl-substituted naphthylamine, and thienyl-substituted aniline. Examples of other suitable aromatic amines include amino-substituted aromatic compounds and amines in which the amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide. Yet other amines include 2,5-dimethoxybenzylamine.

Additional aromatic amines and related compounds are disclosed in U.S. Pat. Nos. 6,107,257 and 6,107,258; some of these include aminocarbazoles, aminoindoles, aminopyrroles, amino-indazolinones, aminoperimidines, mercaptotriazoles, aminophenothiazines, aminopyridiens, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl)amino} butanamide. Other aromatic amines which can be used include various aromatic amine dye intermediates containing multiple aromatic rings linked by, for example, amide structures.

(c) The Aldehyde. The aldehydes suitable for use in this invention include formaldehyde, acetaldehyde, propionaldehyde, pentanal, benzaldehyde, and cyclohexanecarboxaldehyde. Suitable aldehydes thus have the general formula RC(O)H, where R is typically hydrogen or a hydrocarbyl group, as described above, although in all cases R can include other functional groups which do not interfere with the condensation reaction (described below) of the aldehyde with the hydroxyaromatic compound. The aldehydes typically contain 1 to 12 carbon atoms. Such aldehydes include formaldehyde, acetaldehyde, propionaldehyde, butyraldehyde, isobutyraldehyde, pentanal, caproaldehyde, benzaldehyde, and higher aldehydes. Monoaldehydes can be used, such as formaldehyde, which can be supplied as a solution, but is more commonly used in the polymeric form, as paraformaldehyde. Paraformaldehyde may be considered a reactive equivalent of, or a source for, an aldehyde. Other reactive equivalents may include hydrates, alcoholates, or cyclic trimers of aldehydes.

This post treatment, of the succinimide dispersant, as described herein, is believed to result in the reaction of the dispersant with the amine and aldehyde such that a Mannich reaction occurs where the aldehyde forms a link between a remaining —NH group present on the dispersant and an aromatic group of the amine resulting in a Mannich post-treated polyisobutylene dispersant. Alternatively, it is possible the aromatic amine reacts at multiple positions on the dispersant's polyamine head group resulting in cross-linked dispersants, or that some combination of these reaction mechanisms occurs. Of course it is possible that other linkages by other mechanisms could occur. These post-treated dispersants have improved soot handling performance and oxidative stability when compared to the untreated dispersant.

The reaction product as described herein may also, optionally, include as another reactant, a maleinated copolymer. The components may be reacted in any order, such that the maleinated copolymer may be added before or after the amine and aldehyde additions to the dispersant.

(d) The Maleinated Copolymer. The maleinated copolymer employed in the invention is not particularly limited, provided that it contains carboxylic acid functionality or a reactive equivalent of carboxylic acid functionality (e.g., anhydride or ester).

Suitable backbone polymers of the olefin polymer variety include ethylene propylene copolymers, ethylene propylene copolymers further containing a non-conjugated diene, and isobutylene/conjugated diene copolymers, each of which can be subsequently supplied with grafted carboxylic functionality.

The polymerization reaction to form the olefin polymer substrate is generally carried out in the presence of a catalyst in a solvent medium. The polymerization solvent may be any suitable inert organic solvent that is liquid under reaction conditions for solution polymerization of monoolefins, which can be conducted in the presence of a Ziegler-Natta type catalyst or a metallocene catalyst.

Ethylene-propylene or higher alpha monoolefin copolymers may comprise 15 to 80 mole % ethylene and 20 to 85 mole % propylene or higher monoolefin, in some embodiments, the mole ratios being 30 to 80 mole % ethylene and 20 to 70 mole % of at least one $C_3$ to $C_{10}$ alpha monoolefin, for example, 50 to 80 mole % ethylene and 20 to 50 mole % propylene. Terpolymer variations of the foregoing polymers may contain up to 15 mole % of a non-conjugated diene or triene.

In these embodiments, the polymer substrate, that is, typically the ethylene copolymer or terpolymer, can be an oil-soluble, substantially linear, rubbery material having an number average molecular weight which can typically be 1,000 to 100,000, e.g., 5,000 to 50,000 and especially 5,000 to 11,000 (e.g., about 8,000).

The terms polymer and copolymer are used generically to encompass ethylene and/or higher alpha monoolefin polymers, copolymers, terpolymers or interpolymers. These materials may contain minor amounts of other olefinic monomers so long as their basic characteristics are not materially changed.

An ethylenically unsaturated carboxylic acid material is typically grafted onto the polymer backbone. These materials which are attached to the polymer typically contain at least one ethylenic bond (prior to reaction) and at least one, preferably two, carboxylic acid (or its anhydride) groups or a polar group which is convertible into said carboxyl groups by oxidation or hydrolysis. Maleic anhydride or a derivative thereof is suitable. It grafts onto the ethylene copolymer or terpolymer to give two carboxylic acid functionalities. Examples of additional unsaturated carboxylic materials include chlormaleic anhydride, itaconic anhydride, or the corresponding dicarboxylic acids or their esters. Additional examples include maleic acid, fumaric acid and their esters.

The ethylenically unsaturated carboxylic acid material may be grafted onto the polymer (e.g. an ethylene/propylene copolymer) in a number of ways. It may be grafted onto the polymer in solution or in molten form using a radical initiator. The free-radical induced grafting of ethylenically unsaturated carboxylic acid materials in solvents, such as hexane or mineral oil is a preferred method. It is carried out at an elevated temperature in the range of 100° C. to 250° C., e.g., 120° C. to 190° C., or 150° C. to 180° C., e.g., above 160° C., in a solvent such as a mineral lubricating oil solution containing, e.g., 1 to 50 wt. %, or 5 to 30 wt. %, based on the initial total oil solution, of the ethylene/propylene copolymer, typically under an inert environment.

The amount of the reactive carboxylic acid on the polymer chain, and in particular the amount of grafted carboxylic acid on the chain is typically 1% to 5% by weight based on the weight of the polymer backbone, and in an alternative embodiment, 1.5% to 3.5%. These numbers represent the amount of carboxylic-containing monomer such as maleic anhydride and may be adjusted to account for acid monomers having higher or lower molecular weights or greater or lesser amounts of acid functionality per molecule, as will be apparent to the person skilled in the art.

The carboxylic acid functionality can also be provided by a graft process with glyoxylic acid or its homologues or a reactive equivalent thereof of the general formula $R^3C(O)(R^4)_nC(O)OR^5$. In this formula $R^3$ and $R^5$ are hydrogen or hydrocarbyl groups, $R^4$ is a divalent hydrocarbylene group, and n is 0 or 1. Also included are the corresponding acetals, hemiacetals, ketals, and hemiketals. Preparation of grafts of such glyoxylic materials onto hydrocarbon-based polymers is described in detail in U.S. Pat. No. 6,117,941.

The polymer may contain the reactive carboxylic acid functionality as a pendant group attached by, for instance, a grafting process, or it may be present as a monomer copolymerized within the chain. Examples of suitable carboxylic-acid containing polymers include maleic anhydride-styrene copolymers, including partially esterified versions thereof. Nitrogen-containing esterified carboxyl-containing interpolymers prepared from maleic anhydride and styrene-containing polymers are known from U.S. Pat. No. 6,544,935, Vargo et al.

The post treatment of the dispersant with the maleinated copolymer is believed to result in a reaction where the ring of the maleinated polymer is opened at the oxygen atom and one end of the resulting chain reacts with an —NH group present on the dispersant. This reaction step can be done before, after or at the same time the dispersant is treated with the amine and aldehyde, as described above. The resulting post-treated dispersant has improved soot handling performance and oxidative stability when compared to the untreated dispersant.

The Oil of Lubricating Viscosity. The lubricating compositions of this invention employ an oil of lubricating viscosity, including natural or synthetic lubricating oils and mixtures thereof. Natural oils include animal oils and vegetable oils (e.g. castor oil, lard oil) as well as mineral lubricating oils such as liquid petroleum oils and solvent-treated or acid treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, alkylated polyphenyls), alkylated diphenyl ethers and alkylated diphenyl sulfides and the derivatives, analogs and homologues thereof. Alkylene oxide polymers and interpolymers and derivatives thereof where their terminal hydroxyl groups have been modified by processes such as esterification or etherification, constitute another useful class of known synthetic lubricating oils. Another suitable class of synthetic lubricating oils comprises the esters of di- and polycarboxylic acids and those made from $C_5$ to $C_{20}$ monocarboxylic acids and polyols and polyolethers. Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils and silicate oils. Synthetic oils also include those produced by a gas-to-liquid or Fischer-Tropsch process.

Unrefined, refined and rerefined oils, either natural or synthetic (as well as mixtures of two or more of any of these) of the type disclosed hereinabove can be used in the compositions of the present invention. Unrefined oils are those obtained directly from natural or synthetic sources without further purification treatment. Refined oils are similar to the unrefined oils except they have been further treated in one or more purification steps to improve one or more properties. Refined oils include solvent refined oils, hydrorefined oils, hydrofinished oils, hydrotreated oils, and oils obtained by hydrocracking and hydroisomerization techniques.

Oils of lubricating viscosity can also be defined as specified in the American Petroleum Institute (API) Base Oil Interchangeability Guidelines.

The five base oil groups are as follows:

| Base Oil Category | Sulfur (%) | | Saturates (%) | Viscosity Index |
|---|---|---|---|---|
| Group I | >0.03 | and/or | <90 | 80-120 |
| Group II | <0.03 | and | >90 | 80-120 |

-continued

| Base Oil Category | Sulfur (%) | | Saturates (%) | Viscosity Index |
|---|---|---|---|---|
| Group III | <0.03 | and | >90 | >120 |
| Group IV | All polyalphaolefins (PAOs) | | | |
| Group V | All others not included in Groups I, II, III, or IV | | | |

Groups I, II, and III are mineral oil base stocks. Group III base oils are also sometimes considered to be synthetic base oils.

Other Additives. The lubricating oil compositions of this invention may contain other components. The use of such additives is optional and the presence thereof in the compositions of this invention will depend on the particular use and level of performance required. Thus the other additive may be included or excluded. The compositions may comprise a metal salt, frequently a zinc salt of a dithiophosphoric acid. Zinc salts of dithiophosphoric acids are often referred to as zinc dithiophosphates or zinc O,O'-dihydrocarbyl dithiophosphates and are sometimes referred to by the abbreviations ZDP, ZDDP, or ZDTP. One or more zinc salts of dithiophosphoric acids may be present in a minor amount to provide additional extreme pressure, anti-wear and anti-oxidancy performance. Other metal salts of dithiophosphoric acids, such as copper or antimony salts are known and may be included in the lubricating oil compositions of this invention.

Other additives that may optionally be used in the lubricating oils of this invention include detergents, dispersants, viscosity improvers, oxidation inhibiting agents, pour point depressing agents, extreme pressure agents, anti-wear agents, color stabilizers and anti-foam agents. The above-mentioned dispersants and viscosity improvers may be used in addition to the compositions of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, and molybdenum compounds.

Auxiliary viscosity improvers (also sometimes referred to as viscosity index improvers or viscosity modifiers) may be included in the compositions of this invention. Viscosity improvers are usually polymers, including polyisobutenes, polymethacrylic acid esters, hydrogenated diene polymers, polyalkyl styrenes, esterified styrene-maleic anhydride copolymers, hydrogenated alkenylarene-conjugated diene copolymers and polyolefins. Multifunctional viscosity improvers, other than those of the present invention, which also have dispersant and/or antioxidancy properties are known and may optionally be used in addition to the products of this invention.

Detergents are typically overbased materials. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, phenols, phosphonic acids, salixarenes, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Dispersants are well known in the field of lubricants and include primarily what is known as ashless-type dispersants. Dispersants are characterized by a polar group attached to a relatively high molecular weight hydrocarbon chain. Typical dispersants include N-substituted long chain alkenyl succinimides, as described above.

Another class of dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of dispersant is Mannich bases. These are materials which are formed by the condensation of a higher molecular weight, alkyl substituted phenol, an alkylene polyamine, and an aldehyde such as formaldehyde. Such materials may have the general structure

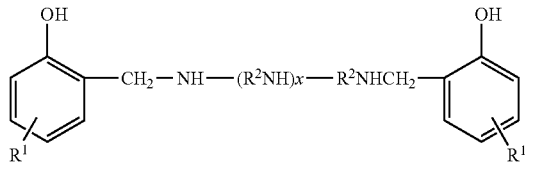

(including a variety of isomers other variations apparent to those skilled in the art) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The above-illustrated additives, when present, may each be present in lubricating compositions at a concentration of as little as 0.001% by weight, usually 0.01% to 20% by weight. In most instances, they each contribute 0.1% to 10% by weight, more often up to 5% by weight.

Additive Concentrates. The various additives described herein can be added directly to the lubricant. In one embodiment, however, they are diluted with a concentrate-forming amount of a substantially inert, normally liquid organic diluent such as mineral oil or a synthetic oil such as a polyalphaolefin to form an additive concentrate. These concentrates usually comprise 0.1 to 80% by weight of the compositions of this invention and may contain, in addition, one or more other additives known in the art or described hereinabove. Concentrations such as 15%, 20%, 30% or 50% of the additives or higher may be employed. By a "concentrate forming amount" it is generally meant an amount of oil or other solvent less than the amount present in a fully formulated lubricant, e.g., less than 85% or 80% or 70% or 60%. Additive concentrates can be prepared by mixing together the desired components, often at elevated temperatures, usually up to 150° C. or 130° C. or 115° C.

Lubricating Oil Compositions. The instant invention also relates to lubricating oil compositions containing the dispersant compositions of the invention. The amount of treated dispersant contained in a fully formulated lubricant is typically 0.1 and 10% by weight, alternatively 0.5 to 6% or 1 to 3% by weight. As noted hereinabove, the compositions of this invention may be blended directly into an oil of lubricating viscosity or, more often, are incorporated into an additive concentrate containing one or more other additives which in turn is blended into the oil.

The described invention can be used as part of a process to improving the soot-handling performance of and/or to control the soot related viscosity increase of a lubricating oil composition, incorporating into said composition a minor amount of the composition described above.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Comparative Example 1

A dispersant is prepared by dissolving 540 g succinated polyisobutylene (2000 Mn conventional polyisobutene reacted with maleic anhydride (1:1.5)) in 571.6 g diluent oil. The mixture is warmed to 110° C. and 37.9 g ethylene polyamine having from about 3 to about 10 nitrogens (HPA-X™ polyethyleneamine bottoms) is added slowly to the mixture. The preparation is stirred at 110° C. for 30 min, and then warmed to 155° C. for 8 hr. The product is filtered through diatomaceous earth, yielding 1081.7 grams of material with a nitrogen content of 1.14% and a kinematic viscosity at 100° C. ('KV100') by ASTM D445 of 210 $mm^2/s$.

Comparative Example 2

A dispersant is prepared by mixing 1050 g of the dispersant from comparative example 1 with 17.4 g of phenol, which is not an aromatic amine. The mixture is warmed to 110° C. and 15.0 g of Formalin (37% by weight aqueous formaldehyde solution) is added drop-wise over 40 min and the preparation is stirred at 110° C. for an additional 2 hr. The material is warmed 150° C. for 5 hr, yielding 1054.5 grams of material with a nitrogen content of 1.17% and a KV100 of 223 $mm^2/s$.

Example 3

A dispersant is prepared by mixing 550 g of the dispersant from comparative example 1 with 27.5 g of phenylamino phenol, an aromatic amine. The mixture is warmed to 85° C. Formalin (12.1 g) is added drop-wise over 1 hr and the preparation is stirred at 85° C. for an additional 2.5 hr. The material is stirred at 130° C. for 3 hr and 155° C. for 1.5 hr, yielding 568.2 grams of material with a nitrogen content of 1.46% and a KV100 of 494 $mm^2/s$.

Example 4

A dispersant is prepared by mixing 1200 g of the dispersant from comparative example 1 with 13.7 g of 4-aminodiphenylamine, an aromatic amine. The mixture is warmed to 85° C. Formalin (6.0 g) is added drop-wise over 0.5 hr and the preparation is stirred at 85° C. for an additional 1.5 hr. The material is stirred at 155° C. for 4.5 hr, yielding 1162.5 grams of material with a nitrogen content of 1.41% and a KV100 of 188 $mm^2/s$.

Example 5

A dispersant is prepared using the method of example 4 with 1200 g of the dispersant from comparative example 1, 38.9 g of 4-aminodiphenylamine, an aromatic amine, and 17.1 g of Formalin, yielding 1187.0 grams of material with a nitrogen content of 1.26% and a KV100 of 216 $mm^2/s$.

Example 6

A dispersant is prepared using the method of example 4 with 1200 g of the dispersant from comparative example 1, 64.1 g of 4-aminodiphenylamine, an aromatic amine, and 28.2 g of Formalin, yielding 1214.4 grams of material with a nitrogen content of 1.74% and a KV100 of 252 $mm^2/s$.

Screen Testing of Compositions in Examples 1-6

A soot-dispersive screen test is performed on the experimental samples prepared above. In this test, a specified amount (e.g., 1 wt. %) of the candidate chemistry is added to a used oil sample from the end of test drain from a Mack™ T-11 engine that exhibited a relatively high degree of viscosity increase. The sample is subjected to oscillation and the ability of the candidate to reduce the buildup of associations between molecules of soot is measured as a modulus, by a method described in Society of Automotive Engineers (SAE) Technical Paper 2001-01-1967, "Understanding Soot Mediated Oil Thickening: Rotational Rheology Techniques to Determine Viscosity and Soot Structure in Peugot XUD-11 BTE Drain Oils," M. Parry, H. George, and J. Edgar, presented at International Spring Fuels & Lubricants Meeting & Exhibition, Orlando, Fla., May 7-9, 2001. The calculated parameter is referred to as G'. The G' of the sample treated with the experimental chemistry is compared to the G' of the drain oil without the additive, the latter of which is defined as 1.00. Values of G' less than 1.00 indicate increasing effectiveness at soot dispersion. Lower values of G' indicate directionally better soot handling performance.

TABLE 1

Screen Test Data for Examples 1-3.

| Dispersant | G' @ 0.5 wt % | G' @ 1.0 wt % |
|---|---|---|
| Comparative Example 1 | 0.19 | 0.05 |
| Comparative Example 2 | 0.17 | 0.06 |
| Example 3 | 0.06 | 0.01 |

TABLE 2

Screen Test Data for Examples 4-6.

| Dispersant | G' @ 0.25 wt % |
|---|---|
| Comparative Example 1 | 0.60 |
| Example 4 | 0.54 |
| Example 5 | 0.40 |
| Example 6 | 0.30 |

The results in Table 1 show that the treated material of Example 3 provides significantly better soot handling performance than does the untreated material of Comparative Example 1. The results also show that the treated material of Example 3 provides significantly better soot handling performance than does the material of Comparative Example 2, which was treated with phenol, and not an aromatic amine.

The results in Table 2 show that the treated materials of Example 4, 5 and 6 provide significantly better soot handling performance than does the untreated material of Comparative Example 1.

Examples 7-12

A heavy duty diesel engine lubricant formulation is prepared by mixing typical amounts of 100N mineral oil, 220N mineral oil, viscosity modifiers, corrosion inhibitors, sulfurized olefins, zinc dithiophosphate, phenate detergents, calcium sulfonate detergents, polybutylene succinic anhydride, additional diluent oil, an antifoam agent and 7.2% by weight of dispersant from examples 1-6, (including diluent oil), as indicated in Table 3 below. Examples 7-12 are prepared using the same formulation of components, such that the lubricants are identical except for the dispersant used.

In these examples the dispersant from Examples 1-6, the corrosion inhibitors, sulfurized olefins, zinc dithiophosphate, phenate detergents, calcium sulfonate detergents, polybutylene succinic anhydride, additional diluent oil and antifoam agent are pre-mixed, in the proper proportions, as a concentrate, that is then mixed with the mineral oils and viscosity modifiers resulting in the formulation above.

The oxidative stabilities of blended oils containing the compositions in Examples 1-6 are tested in a motor oil formulation. The method uses pressure differential scanning calorimetry (PDSC) to measure the oxidation induction time of the blended oil. The method holds the samples at a constant temperature, roughly 25° C. below the average decompositions temperature for such materials, until exothermic decomposition occurs. The time the sample is held at temperature until the exothermic decomposition is the sample's oxidative induction time (OIT). A higher induction time indicates improved oxidative stability.

TABLE 3

PDSC Oxidation Induction.

| Example | Dispersant used in formulation | Oxidation Induction Time (min) |
|---|---|---|
| Comparative Example 7 | Comparative Example 1 | 37 |
| Comparative Example 8 | Comparative Example 2 | 42 |
| Example 9 | Example 3 | 75 |
| Example 10 | Example 4 | 70 |
| Example 11 | Example 5 | 79 |
| Example 12 | Example 6 | 80 |

The results show that the blends of Examples 9, 10, 11 and 12, prepared using the treated materials from Examples 3, 4, 5 and 6 respectively, have much more oxidative stability than Comparative Example 7, prepared using untreated material from Comparative Example 1. The results also show that the blends of Examples 9, 10, 11 and 12, prepared using the treated materials from Examples 3, 4, 5 and 6 respectively, provide significantly better oxidative stability than Comparative Example 8, prepared using the phenol treated material of Comparative Example 2.

The improved benefits in soot handling and oxidative stability seen in the examples show the benefit of the claimed invention. Comparing Examples 4, 5, 6, 9, 10, 11 and 12, which represent the claimed invention, to Comparative Examples 1 and 7, which represent non-treated dispersants, show that the claimed invention provides benefits over the non-treated dispersants. Comparing Examples 4, 5, 6, 9, 10, 11 and 12, which represents the claimed invention, to Comparative Examples 2 and 8, which represent treated dispersants but those which are not treated with aromatic amines and aldehydes, shows that the claimed invention provides benefits over a dispersant treated with different materials.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

The term "minor amount" means an amount of less than 50% of the substance in question as a fraction of the total composition unless otherwise indicated above.

What is claimed is:

1. A composition comprising the reaction product of:

(a) a polyisobutylene-substituted succinimide dispersant prepared from (i) a 1500 to 2500 number average molecular weight polyisobutylene reacted with maleic anhydride and (ii) a polyethylene polyamine;

(b) an aromatic amine comprising 4-aminodiphenylamine; and (c) an aldehyde;

wherein the reaction mixture used to prepare the reaction product contains on an actives basis from 50 to 98 percent by weight of component (a), from 5 to 10 percent by weight of component (b), and from 2 to 5 percent by weight of component (c), where the reaction mixture optionally includes diluent oil.

2. The composition of claim 1 further reacted with (d) a maleinated copolymer, where components (b), (c) and (d) are reacted with component (a) in any order or simultaneously.

3. The composition of claim 1 wherein component (c), the aldehyde, is selected from the group consisting of formaldehyde, paraformaldehyde, reactive equivalents thereof, or mixtures thereof.

4. The composition of claim 2 wherein component (d), the maleinated copolymer, comprises a maleinated ethylene-propylene copolymer.

5. A lubricant composition comprising a major amount of an oil of lubricating viscosity and a minor amount of the composition of claim 1.

6. The lubricant composition of claim 5 further comprising at least one additive selected from the group consisting of detergents, viscosity modifiers, antioxidants, and anti-wear agents.

7. The lubricant composition prepared by admixing the components of claim 6.

8. A concentrate comprising the composition of claim 1 and a concentrate-forming amount of an oil of lubricating viscosity.

9. A process for lubricating a mechanical device comprising supplying thereto the composition of claim 1.

10. A process for lubricating an internal combustion engine comprising supplying thereto the composition of claim 1.

11. The process of claim 10 wherein the internal combustion engine is a heavy duty diesel engine.

12. The process of claim 10 wherein the internal combustion engine is a heavy duty diesel engine with exhaust-gas recirculation.

13. A process for improving the soot-handling performance of a lubricating oil composition incorporating into said composition a minor amount of the composition of claim 1.

14. A process for producing a post-treated polyisobutylene substituted succinimide dispersant, comprising reacting:

(a) a polyisobutylene-substituted succinimide dispersant prepared from (i) a 1500 to 2500 number average molecular weight polyisobutylene reacted with maleic anhydride and (ii) a polyethylene polyamine;

(b) an aromatic amine comprising 4-aminodiphenylamine; and (c) an aldehyde;

wherein the reaction mixture used to prepare the reaction product contains on an actives basis from 50 to 98 percent by weight of component (a), from 5 to 10 percent by weight of component (b), and from 2 to 5 percent by weight of component (c), where the reaction mixture optionally includes diluent oil.

15. The process of claim 14 further reacted with (d) a maleinated copolymer, where components (b), (c) and (d) can be reacted with component (a) in any order or simultaneously.

16. A process for lubricating an internal combustion engine, comprising supplying thereto to the lubricant composition of claim 5.

17. The composition of claim 1 wherein the reaction mixture used to prepare the reaction product contains on an actives basis from 50 to 98 percent by weight of component (a), from 6.3 to 9.7 percent by weight of component (b), and from 2.7 to 4.3 percent by weight of component (c), where the reaction mixture optionally includes diluent oil.

18. The composition of claim 17 wherein the resulting reaction product of said reaction mixture has a nitrogen content from 1.26 to 1.74 percent by weight.

19. The process of claim 14 wherein the reaction mixture used to prepare the reaction product contains on an actives basis from 50 to 98 percent by weight of component (a), from 6.3 to 9.7 percent by weight of component (b), and from 2.7 to 4.3 percent by weight of component (c), where the reaction mixture optionally includes diluent oil.

20. The process of claim 15 wherein the resulting reaction product of said reaction mixture has a nitrogen content from 1.26 to 1.74 percent by weight.

* * * * *